US007491297B2

(12) United States Patent
Serr et al.

(10) Patent No.: US 7,491,297 B2
(45) Date of Patent: Feb. 17, 2009

(54) PAPERMACHINE CLOTHING

(75) Inventors: Martin Serr, Bachhagel (DE); Lena Johannson, Soederkoeping (SE); Scott Quigley, Townville, SC (US); Volker Schmidt-Rohr, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 441 days.

(21) Appl. No.: 11/227,815

(22) Filed: Sep. 14, 2005

(65) Prior Publication Data

US 2006/0063451 A1 Mar. 23, 2006

(30) Foreign Application Priority Data

Sep. 15, 2004 (DE) ..... 10 2004 044 572

(51) Int. Cl.
*D21F 1/00* (2006.01)
*D21F 11/00* (2006.01)
*B32B 3/26* (2006.01)

(52) U.S. Cl. ..... 162/348; 162/203; 162/300; 162/903; 428/131; 428/132; 428/133; 428/156; 428/174

(58) Field of Classification Search ..... 162/116, 162/203, 298–304, 306, 348, 349, 358.2, 162/358.4, 900–904; 428/131–133, 156, 428/161, 174, 179; 139/383 A, 425 A
See application file for complete search history.

(56) References Cited

U.S. PATENT DOCUMENTS

| | | | | |
|---|---|---|---|---|
| 4,423,755 | A * | 1/1984 | Thompson | 139/383 A |
| 4,500,588 | A | 2/1985 | Lundstroem et al. | |
| 4,592,395 | A | 6/1986 | Borel et al. | |
| 4,998,568 | A * | 3/1991 | Vohringer | 139/383 A |
| 5,334,289 | A | 8/1994 | Trokhan et al. | |
| 5,564,475 | A | 10/1996 | Wright et al. | |
| RE35,777 | E | 4/1998 | Givin et al. | |
| 6,017,417 | A | 1/2000 | Wendt et al. | |
| 6,148,869 | A | 11/2000 | Quigley et al. | |
| 6,240,973 | B1 * | 6/2001 | Stone et al. | 139/383 A |
| 6,581,645 | B1 * | 6/2003 | Johnson et al. | 139/383 A |
| 6,745,797 | B2 * | 6/2004 | Troughton | 139/383 A |
| 2004/0020614 | A1 | 2/2004 | Dean et al. | |
| 2004/0237210 | A1 | 12/2004 | Thoroe-Scherb et al. | |

FOREIGN PATENT DOCUMENTS

| | | |
|---|---|---|
| WO | WO 98/01618 | 1/1998 |
| WO | WO 99/16964 | 4/1999 |
| WO | WO 03/000002 | 1/2003 |
| WO | WO 03/016620 | 2/2003 |
| WO | WO 03/016620 A | 2/2003 |
| WO | WO 2005/001197 | 1/2005 |
| WO | WO 2005/075737 | 8/2005 |
| WO | WO 2005/075737 A | 8/2005 |

OTHER PUBLICATIONS

European Search Report Apr. 12, 2006.
European Search Report Jan. 25, 2006.

* cited by examiner

*Primary Examiner*—Eric Hug
(74) *Attorney, Agent, or Firm*—Taylor & Aust, P.C.

(57) ABSTRACT

Papermaching clothing for conveying a fibrous web in a machine for producing the fibrous web, whereby a fabric made of fibers which run in the machine direction and in the transverse direction, is disclosed having circular fibers, flat fibers or, as compared with the plane of the clothing formed by them, flattened fibers, such as fibers having an elliptical cross section.

12 Claims, 3 Drawing Sheets

PAPERMACHINE CLOTHING

CROSS-REFERENCE TO RELATED APPLICATIONS

The present application claims priority under 35 U.S.C. §119 of German Patent Application No. 10 2004 044 572.9 filed on Sep. 15, 2004, the disclosure of which is expressly incorporated by reference herein in its entirety.

BACKGROUND OF INVENTION

1. Field of the Invention

The invention relates to clothing for conveying a fibrous web in a machine for producing the fibrous web, in particular for use in a gap former of a machine for producing a fibrous web.

2. Discussion of Background Information

U.S. Pat. Nos. 5,826,627 and 5,152,326 disclose fabrics which consist of a plurality of woven layers with weft and warp threads, the layers being connected to one another by individual threads. In this case, there are different possibilities for connecting the woven layers to one another. Fabrics of this type are used as clothing in papermachines.

In the case of paper webs produced by means of the known clothing, there is the problem that the printing quality is not always adequate, which manifests itself, for example, by the lack of printed dots (missing dots) or else by means of an excessively high roughness (PPS roughness). There are also problems with the runnability of the paper web, in particular in the fabric separation region, where it is possible for water to be sprayed from the wet-end clothing running on the top side.

SUMMARY OF THE INVENTION

The object of the invention is to provide clothing which is suitable for use in particular at the wet end and in particular for the production of high-quality SC papers.

According to the invention, in the case of clothing of the type mentioned at the beginning, this object is achieved in that the clothing (2, 3) has support points on the side facing the fibrous web of 1400/cm$^2$ or more, preferably 1500 cm$^2$ or more, quite particularly preferably 1600/cm$^2$ or more and most preferably 1700/cm$^2$ or more fiber support points.

Advantageous developments of the invention are contained in the subclaims, the description and the drawings.

It is advantageous if, in the case of the use of a fabric for the clothing, the fiber support points are formed by fiber crossing points of a fabric made of threads which run in the machine direction and in the transverse direction.

In a further advantageous refinement, provision is made for the threads to have a circular or, as compared with the plane of the clothing formed by them, a flat or flattened, in particular elliptical cross section.

By means of the invention, the printing quality of the paper can be improved if the clothing according to the invention, which can be formed as woven fabrics or as membranes, is used in the wet end and/or in the press section. As a result of the invention, sufficiently fine structures within the fabric or the fabric layers of the clothing are made possible. In order to create a particularly smooth surface of the membrane or the clothing, the latter can be ground off on the surface, in particular on the side facing the paper web.

The fabrics for the wet-end clothing are advantageously chosen such that the diameter of the circular threads is 0.13 mm or less, in particular 0.11 mm or less, or that the flat threads have a width of 0.11 mm or less and that they have a thickness of 0.13 mm or less, in particular of 0.11 mm or less, quite particularly of 0.08 mm or less.

It is likewise also advantageous if the clothing is an SSB fabric (SSB=self supporting binder).

As alternative to a fabric, the clothing according to the invention can comprise a membrane or can be formed by a membrane. In this case, it is conceivable for the fiber support points to be formed by elevations of the membrane. However, it is also possible to imagine that the fiber support points are formed by surfaces of a membrane, there being depressions or holes in the membrane between the surfaces.

In an advantageous refinement, provision is made for the clothing or the membrane to have elevations or hills as load-bearing points on the side facing the fibrous web and otherwise to have a flat surface. The water sucked out or pressed out of the fibrous suspension or the fibrous web can run away between the elevations. The water contained in the fibrous suspension or the fibrous web can run onto the side facing away through holes or continuous openings in the clothing or the membrane.

The elevations are advantageously produced in such a way that they have a height of at most 0.08 mm, in particular at most 0.06 mm, quite particularly of at most 0.04 mm. The elevations can have a diameter between 0.1 and 0.4 mm.

A further preferred embodiment of the invention provides for the elevations to have a diameter between 0.1 and 0.4 mm.

Use can advantageously also be made of clothing which has a thickness of 0.7 mm or less, in particular of less than 0.63 mm, quite particularly of less than 0.58 mm.

In order to ensure good dewatering of the fibrous web, there are empty spaces within the clothing or the membrane. The number of empty spaces within the fabric on the side facing the fibrous web is advantageously less than or equal to the number of empty spaces on the side facing away from the fibrous web.

In order to increase the smoothness of the clothing or the membrane, it is possible to provide for it to be ground off or calendered on its surface facing the fibrous web.

The invention can be used both in the case of clothing which comprises a fabric or is formed by a fabric and also in the case of clothing which comprises a membrane or is formed by a membrane.

The invention likewise relates to a method for producing a membrane in which the elevations according to the invention are produced on the surface of the clothing or the membrane by means of a casting mold, in particular by means of an injection molding process, by a drilling process, by ablation, in particular laser ablation, by erosion, in particular by spark erosion.

Likewise, the invention also relates to a method for producing a fibrous web, in particular a paper web, which is suitable for gravure printing. In this case, use is made of a gap former (wire former) in which either the top fabric or the carrier fabric or both fabrics are produced from clothing according to the invention. The fibrous web is produced at a speed of 1600 m/min or more, in particular of 1700 m/min or more, quite particularly of 1800 m/min or more.

In the following text, the invention will be explained in more detail in exemplary embodiments.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
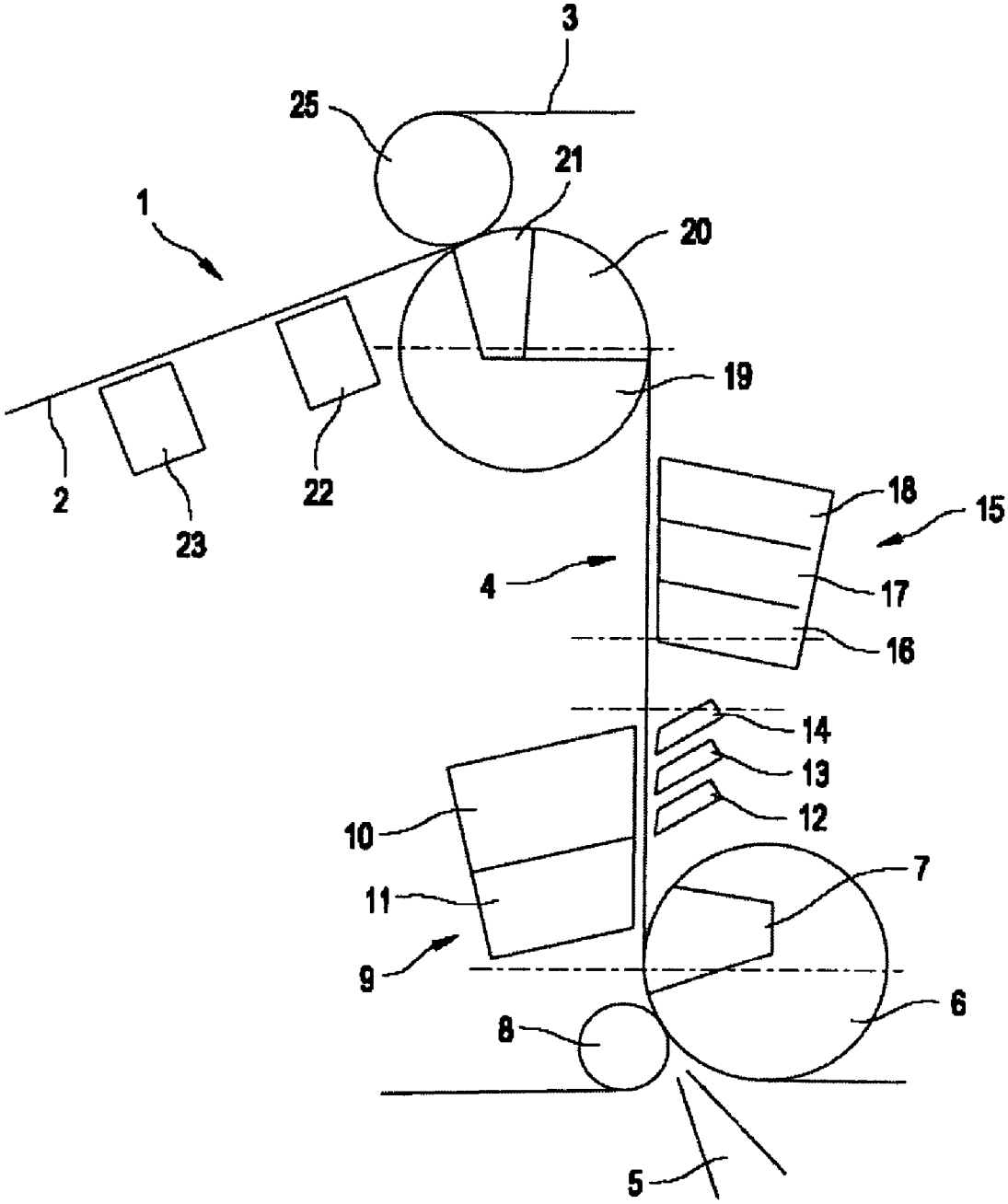
FIG. 1 shows a wet end in a schematic illustration.

A twin-wire former 1 (FIG. 1) comprises a carrier fabric 2 and a top fabric 3, between which, in a twin-wire section 4, a fibrous web is produced from a fibrous suspension supplied in a headbox 5. The top fabric 3 wraps around a forming roll 6 having a suction zone 7, while the carrier fabric 2 is guided over an opposite deflection roll 8. On the side of the carrier fabric 2, a suction device 9 having two suction zones 10, 11 is arranged in the region of the twin-wire section 4. Foils 12, 13, 14 are located opposite the suction device 9. On the side of the top fabric 3, a suction device 15 having suction zones 16, 17 and 18 is fitted.

The carrier fabric 2 is led over a fabric suction roll 19 having two suction zones 20, 21 at the end of the twin-wire section 4. The carrier fabric 2 then moves past two suction devices 22, 23. The top fabric 3 is led onward over a deflection roll 25.

Figure 2:
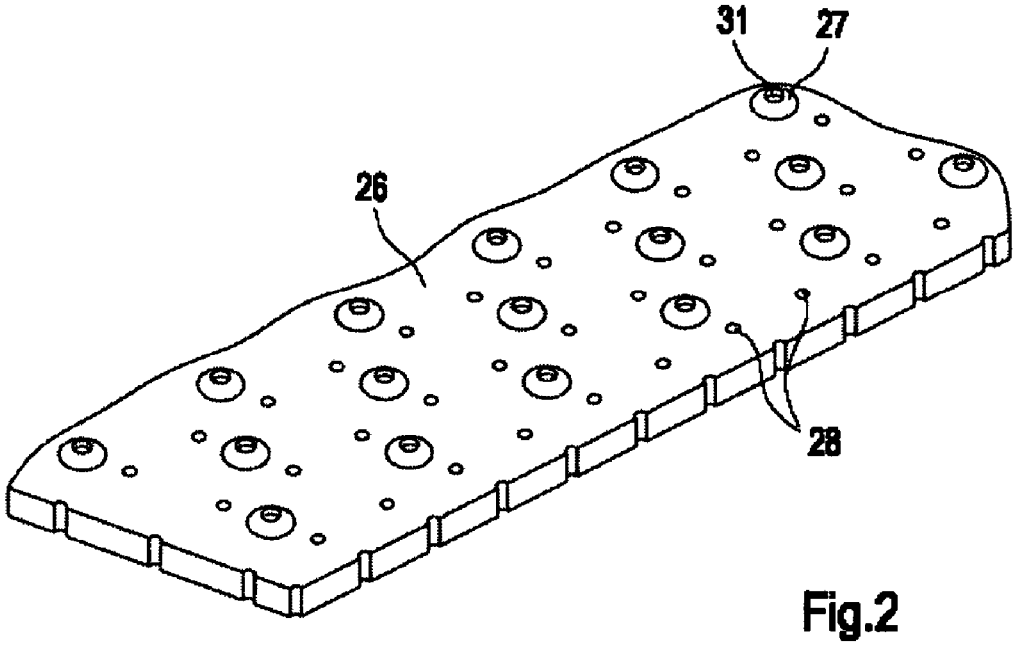
FIG. 2 shows a perspective plan view of a fabric.
Figure 3:
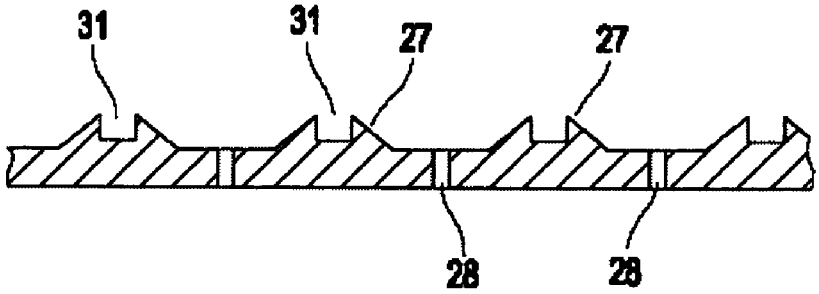
FIGS. 3, 4 show sectional views of two different fabrics.
Figure 4:
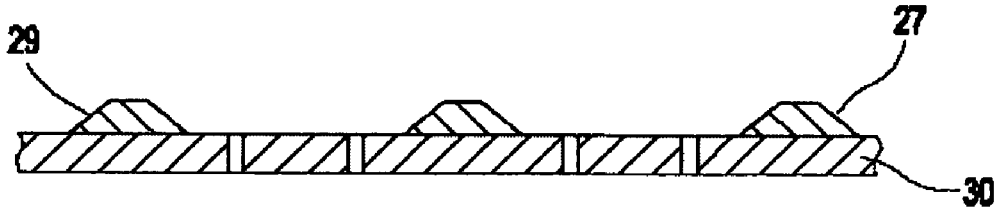

The carrier fabric 2 and the top fabric 3 are constructed, for example, as illustrated in FIG. 2. On the surface 26 facing the fibrous web there are elevations 27, which have a height of for example 0.07 mm. Between the elevations 27, within the surface 26, there are holes 28, through which water discharged by the fibrous web passes and is carried away. Optionally, provision can be made, as indicated in FIG. 2 and FIG. 3, for the elevations to have depressions 31 in the central region. The depressions 31 could alternatively also be holes passing through the carrier fabric 2 or the top fabric 3.

The elevations 27 have a plateau-like or cup-like design (cf. FIG. 3). The fabric 2 or 3 consists of a single material or else is constructed from an underlayer 30 provided with a coating 29. The underlayer 30 consists of a plastic and can be reinforced with threads in the CD and/or MD direction, which can be interwoven or not interwoven. The fabric 2 or 3 has a permeability between 40 cfm and 1500 cfm.

Figure 5:
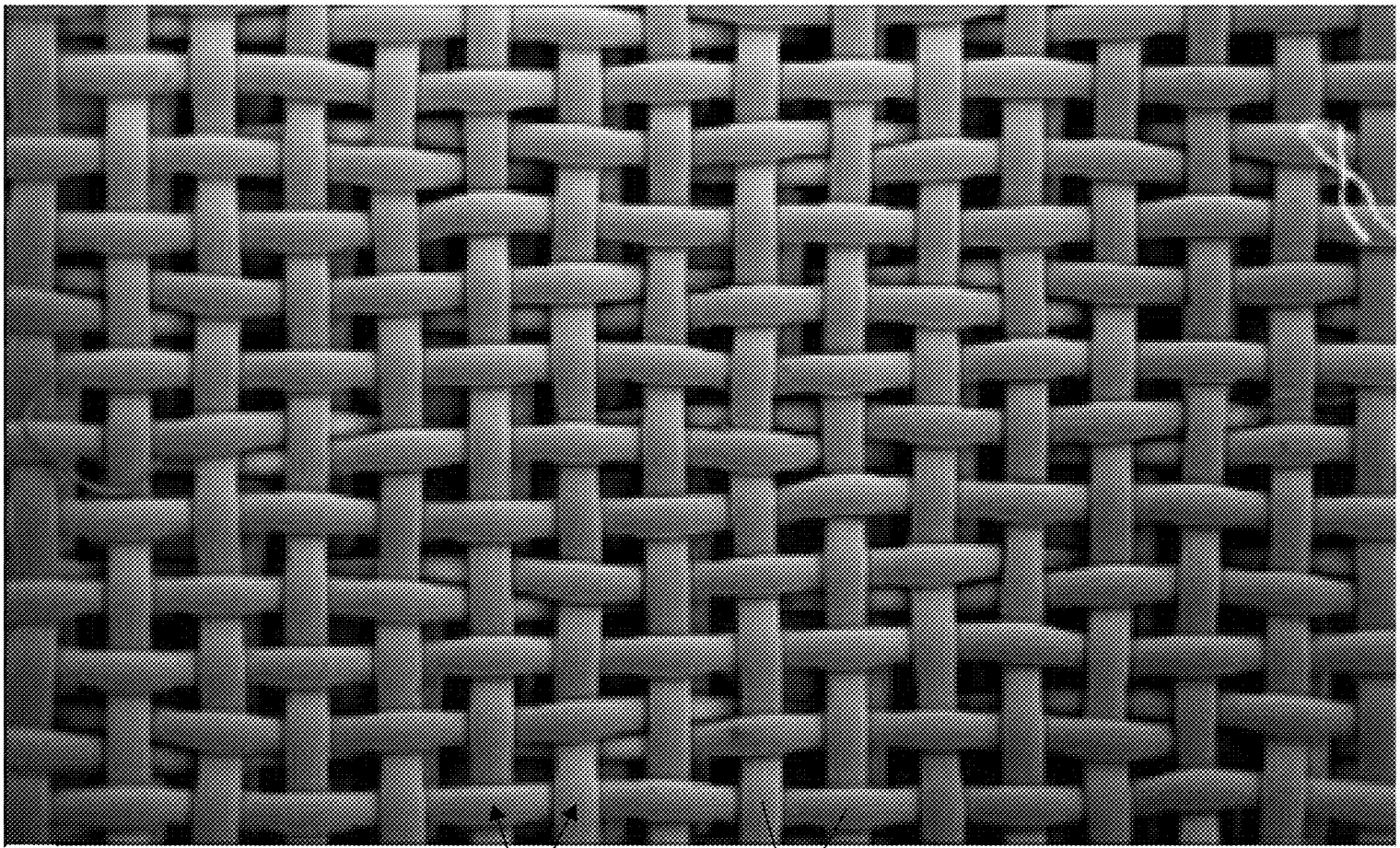
FIG. 5 provides a photograph showing the paper side of a forming fabric according to the present invention, the fiber support points being formed by fiber crossing points.

The coating 29 can be applied to the underlayer by means of various processes, for example by means of a casting process, in particular an injection molding process. The interspaces between the elevations 27, which are intended to remain, are then removed by various processes. Alternatively, by means of a stencil fitted to a roll, a surface can be produced on the coating which has the desired number of elevations 27, or the membrane is produced as a whole by pulling between rolls. FIG. 5 shows a forming fabric 32 having 1400/cm$^2$ or more fiber support points 34 on the side of fabric 32 facing the fibrous web. The fiber support points 34 in FIG. 5 are formed by the fiber crossing points 34 of fabric 32 made of threads 36 which run in the machine direction and in the transverse direction.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present extends to all functionally equivalent structures, methods and uses, such as are within the scope of the appended claims.

The invention claimed is:

1. A clothing that conveys a fibrous web, in particular a paper web, which is suitable for gravure printing, in a machine for producing the fibrous web, said clothing comprising:

1400/cm$^2$ or more fiber support points on a side of the clothing facing the fibrous web, the clothing comprising a membrane, the fiber support points being formed by elevations of the membrane.

2. The clothing of claim 1, further comprising elevations or hills serving as loadbearing points on a side facing the fibrous web, and otherwise a flat surface.

3. The clothing of claim 2, wherein the elevations have a height of at most 0.08mm.

4. The clothing of claim 3, wherein the elevations have a diameter between 0.1and 0.4 mm.

5. The clothing of claim 1, wherein the clothing has a thickness of less than or equal to 0.7 mm.

6. The clothing of claim 1, wherein a number of empty spaces within the fabric on a side facing the fibrous web is less than or equal to the number of empty spaces on the side facing away from the fibrous web.

7. The clothing of claim 1, wherein the clothing surface facing the fibrous web is at least one of ground off and calendered.

8. A method for producing the clothing of claim 1, wherein the elevations are produced on the surface of the clothing by means of a casting mold.

9. A method for producing clothing as claimed in claim 8, wherein the casting mold is at least one of a means of an injection molding process, a drilling process, ablation, laser ablation, erosion, and spark erosion.

10. The clothing of claim 1, wherein the clothing is structured and arranged for being used in a gap former (wire former) and for producing the fibrous web at a speed of 1600m/min or more.

11. A method for producing a fibrous web, in particular a paper web, which is suitable for gravure printing, using clothing as including 1400/cm$^2$ or more fiber support points on a side of the clothing facing the fibrous web, the clothing conveying the fibrous web in a machine for producing the fibrous web and being used in a gap former (wire former) wherein the fibrous web is produced at a speed of 1600 m/min or more.

12. A clothing for conveying a fibrous web in a machine for producing the fibrous web, in particular for use in a gap former of the machine for producing the fibrous web, said clothing comprising:

a membrane including at least 1400/cm$^2$ fiber support points on a side of the clothing facing the web, said fiber support points including one of a plurality of elevations of said membrane and a plurality of surfaces of said membrane with one of a plurality of depressions and a plurality of holes between said plurality of surfaces.

* * * * *